US007257357B2

(12) United States Patent
Lundy et al.

(10) Patent No.: US 7,257,357 B2
(45) Date of Patent: Aug. 14, 2007

(54) PHOTORECEPTOR CHARGING SYSTEMS AND METHODS

(75) Inventors: Douglas A. Lundy, Webster, NY (US); Michael J. Turan, Walworth, NY (US); Huoy-Jen Yuh, Pittsford, NY (US); Moritz Wagner, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 22 days.

(21) Appl. No.: 11/131,319

(22) Filed: May 17, 2005

(65) Prior Publication Data

US 2006/0263118 A1 Nov. 23, 2006

(51) Int. Cl.
*G03G 15/16* (2006.01)

(52) U.S. Cl. ..... 399/296; 399/50

(58) Field of Classification Search ..... 399/296, 399/50, 129

See application file for complete search history.

(56) References Cited

U.S. PATENT DOCUMENTS 5,600,413 A * 2/1997 Kimura ..... 399/174
2002/0078241 A1 6/2002 Kumar et al.
2003/0071885 A1 4/2003 Kamoshida et al.
2003/0228177 A1 12/2003 Hirsch
2004/0218939 A1* 11/2004 Motohashi et al. ..... 399/50

* cited by examiner

*Primary Examiner*—David M. Gray
*Assistant Examiner*—David A Blackshire
(74) *Attorney, Agent, or Firm*—Gibb & Rahman, LLC

(57) ABSTRACT

Embodiments herein comprise a charging station adjacent a photoreceptor. The charging station is adapted to charge the document zone of the photoreceptor with a first negative voltage and to charge the inter-document zone of the photoreceptor with a second negative voltage that is more negative than the first negative voltage. The second more negative voltage reduces the amount of positive charges trapped within layers of the inter-document zone of the photoreceptor. Thus, when the charging station increases the size of the document zone from a smaller size associated with a smaller printing medium to a larger size associated with a larger printing medium, by reducing the positive charges from being trapped within layers of the inter-document zone of the photoreceptor, ghosting is reduced on the larger printing medium.

20 Claims, 3 Drawing Sheets

PHOTORECEPTOR CHARGING SYSTEMS AND METHODS

BACKGROUND

Embodiments herein generally relate to methods and systems that reduce ghosting effects.

Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

U.S. Patent Publication 2003/0071885, incorporated herein by reference, discloses a system that reduces the ghost effect by adding "a surface potential adjusting member" that uniformly cleans the photoreceptor after the charge has been transferred to the printing medium. U.S. Patent Publication 2003/0228177, incorporated herein by reference, discloses a system that reduces a lightened ghost image of a previously developed image in a halftone or solid on a print. U.S. Patent Publication 2002/0076241, incorporated herein by reference, discloses a system that uses a developer material disturbing (DMD) member mounted into moving contact with the donor roll, and downstream of the development nip, for disturbing the spent layer of developer material on the donor roll, thereby preventing ghosting effects occurring in subsequently developed toner images by eliminating any ghost effects of a previously developed toner image from the spent layer of developer material on the donor roll.

SUMMARY

Embodiments herein generally relate to methods and systems that precharge the inter-document zone of a photoreceptor with a higher negative voltage than the document zone in order to reduce ghosting effects.

More specifically, an apparatus embodiment herein comprises a charging station adjacent the photoreceptor positioned before the transfer station. This charging station is adapted to charge the document zone of the photoreceptor with a first negative voltage and to charge the inter-document zone of the photoreceptor with a second negative voltage that is more negative than the first negative voltage.

When the photoreceptor goes through the positively charging field from the transfer device the second more negative voltage reduces an amount of positive charges trapped within layers of the inter-document zone of the photoreceptor. Thus, when the charging station increases the size of the document zone from a smaller size associated with a smaller printing medium to a larger size associated with a larger printing medium, by reducing the positive charges from being trapped within layers of the inter-document zone of the photoreceptor, ghosting is reduced on the larger printing medium. The ghosting is reduced mostly on the portion of the larger printing medium that is longer than the smaller printing medium. Thus, by reducing the positive charges from being trapped within layers of the inter-document zone of the photoreceptor, ghosting is reduced on the leading edges and/or the trailing edges of the printing medium.

A transfer station is used to transfer the toner from the photoreceptor to a printing medium. The transfer station applies a positive voltage current to the backside of the printing medium in order to cause the toner to transfer from the photoreceptor to the printing medium. In embodiments herein, the transfer station also helps limit ghosting by shutting off, or substantially reducing the positive current as the inter-document zone of the photoreceptor passes the transfer station. This is intended to aid in the effort to reduce the amount of positive charges applied to the inter-document zone of the photoreceptor.

In addition, the apparatus embodiment includes a standard exposure device adjacent the photoreceptor, which is used to pattern a discharge area on the document zone of the photoreceptor. A standard development station is used to attach toner to the discharged regions of the photoreceptor. This can be followed by a fuser, etc.

A method embodiment herein charges the document zone of the photoreceptor with the first negative voltage and charges the inter-document zone of the photoreceptor with the second negative voltage that is more negative than the first negative voltage. Next, the method patterns the charge on the document zone of the photoreceptor. Toner is attached to the discharged regions of the photoreceptor and the toner is transferred from the photoreceptor to the printing medium. The transfer station transfers the toner from the photoreceptor to a printing medium by applying a first transfer current to the back of the printing medium and applying a second transfer current (zero current or substantially reduced current) to the inter-document zone of the photoreceptor.

Again, with the method, the second negative voltage reduces the amount of positive charges trapped within layers of the inter-document zone of the photoreceptor. The method can increase the size of the document zone from a smaller size associated with a smaller printing medium to a larger size associated with a larger printing medium. By reducing the positive charges from being trapped within layers of the inter-document zone of the photoreceptor, ghosting is reduced on the larger printing medium. More specifically, the ghosting is reduced on the portion of the larger printing medium that is longer than the smaller printing medium. Thus, by reducing the positive charges from being trapped within layers of the inter-document zone of the photoreceptor, ghosting is reduced on the leading edges and/or the trailing edges of the printing medium.

These and other features are described in, or are apparent from, the following detailed description.

BRIEF DESCRIPTION OF THE DRAWINGS

Various exemplary embodiments of the systems and methods described in detail below, with reference to the attached drawing figures, in which.

DETAILED DESCRIPTION

As mentioned above, embodiments herein generally relate to methods and systems that precharge the inter-document zone of a photoreceptor with a higher negative voltage than the document zone in order to reduce ghosting effects. The second negative voltage reduces the amount of positive charges trapped within layers of the inter-document zone of the photoreceptor. By reducing the positive charges from being trapped within layers of the inter-document zone of the photoreceptor, ghosting is reduced on the leading edges and/or the trailing edges of the printing medium.

Figure 1:
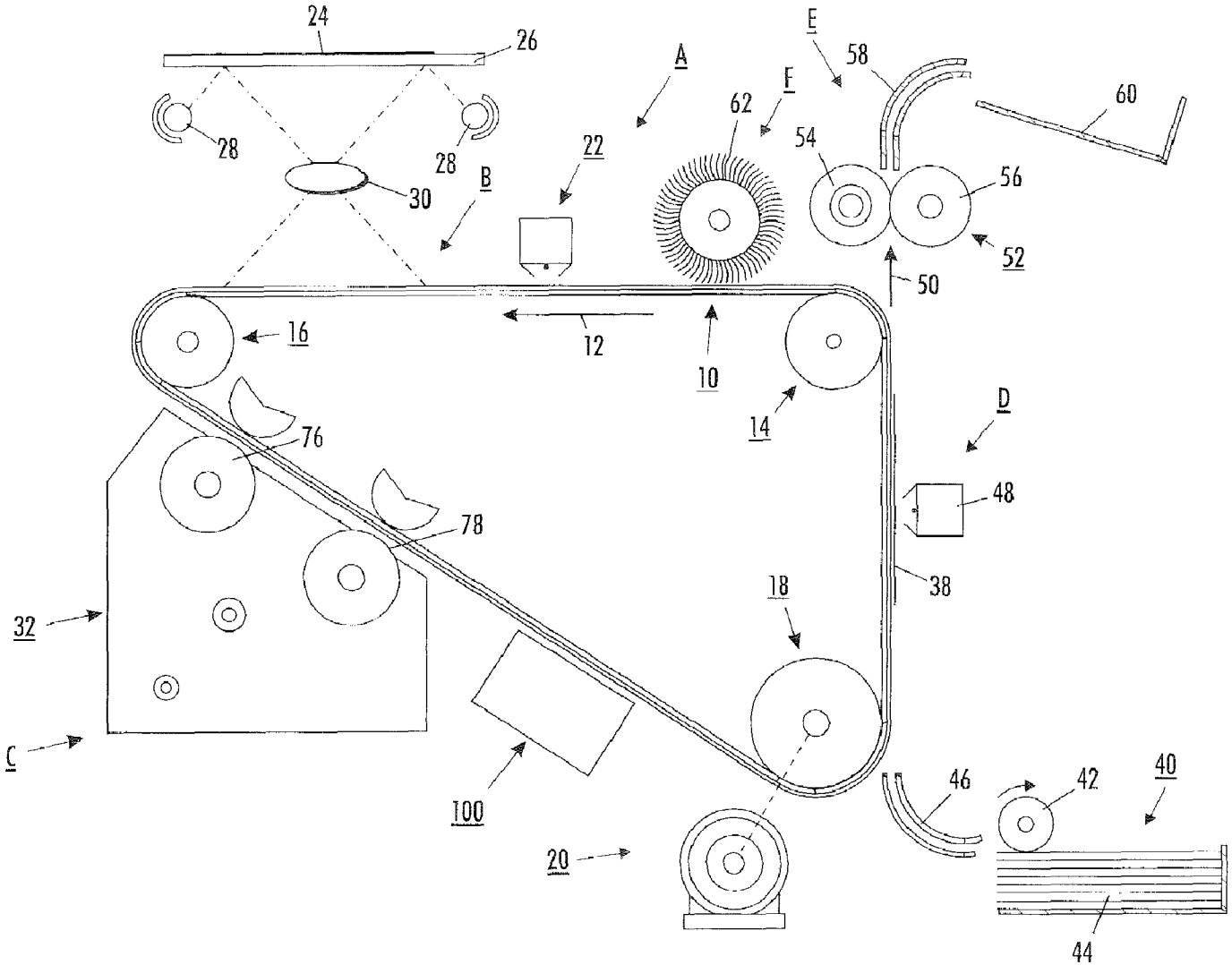
FIG. 1 is a schematic representation of a printing engine.

FIG. 1 schematically depicts the various components of an illustrative electrophotographic printing machine incorporating the charging station of the present invention. A similar system is shown, for example, in U.S. Patent Publication 2003/0228177. It will become evident from the following discussion that this development apparatus is equally well suited for use in a wide variety of electrostatographic printing machines and for use in ionographic printing machines. Because the various processing stations employed in the FIG. 1 printing machine are well known, they are shown schematically and their operation will be described only briefly.

The printing machine shown in FIG. 1 employs a photoconductive belt 10 of any suitable type, which moves in the direction of arrow 12 to advance successive portions of the photoconductive surface of the belt through the various stations disposed about the path of movement thereof. As shown, belt 10 is entrained about rollers 14 and 16 which are mounted to be freely rotatable and drive roller 18 which is rotated by a motor 20 to advance the belt in the direction of the arrow 12.

Initially, a portion of belt 10 passes through a charging station A. At charging station A, a corona generation device, indicated generally by the reference numeral 22, charges a portion of the photoconductive surface of belt 10 to a relatively high, substantially uniform negative potential.

Next, the charged portion of the photoconductive surface is advanced through an exposure station B. At exposure station B, an original document 24 is positioned face down upon a transparent platen 26. Lamps 28 flash light onto the document 24 and the light that is reflected is transmitted through lens 30 forming a light image on the charged portion of the photoconductive surface. The charge on the photoconductive surface is thereby selectively dissipated, leaving an electrostatic latent image on the photoconductive surface which corresponds to the original document 24 disposed upon transparent platen 26. The belt 10 then advances the electrostatic latent image to a development station C.

At development station C, a development apparatus indicated generally by the reference numeral 32, transports toner particles to develop the electrostatic latent image recorded on the photoconductive surface. Toner particles are transferred from the development apparatus to the latent image on the belt, forming a toner powder image on the belt, which is advanced to transfer station D.

At transfer station D, a sheet of support material 38 is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D. Transfer station D includes a corona generating device 48 which sprays ions onto the back side of sheet 38. This attracts the toner powder image from the photoconductive surface to sheet 38. After transfer, the sheet continues to move in the direction of arrow 50 into a conveyor (not shown) which advances the sheet to fusing station E.

Fusing station E includes a fusing assembly, indicated generally by the reference numeral 52, which permanently affixes the transferred powder image to sheet 38. Preferably, fuser assembly 52 includes a heated fuser roller 54 and back-up roller 56. Sheet 38 passes between fuser roller 54 and back-up roller 56 with the toner powder image contacting fuser roller 54. In this way, the toner powder image is permanently affixed to sheet 38.

After fusing, chute 58 guides the advancing sheet to catch tray 60 for subsequent removal from the printing machine by the operator. Invariably, after the sheet of support material is separated from the photoconductive surface of belt 10, some residual toner particles remain adhering thereto. These residual particles are removed from the photoconductive surface at cleaning station F.

Cleaning station F includes a pre-clean corona generating device (not shown) and a rotatably mounted fibrous brush 62 in contact with the photoconductive surface of belt 10. The pre-clean corona generating device neutralizes the charge attracting the particles to the photoconductive surface. These particles are cleaned from the photoconductive surface by the rotation of brush 62 in contact therewith. Subsequent to cleaning, a discharge lamp (not shown) floods the photoconductive surface with light to dissipate any residual charge remaining thereon prior to the charging thereof for the next successive imaging cycle.

Figure 2:
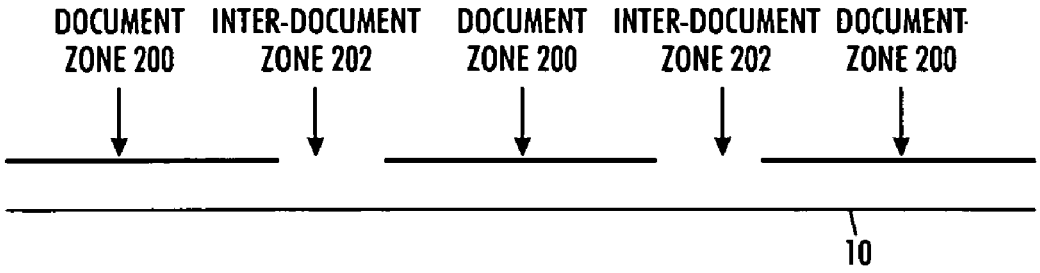
FIG. 2 is a schematic representation of a photoreceptor.
Figure 3:
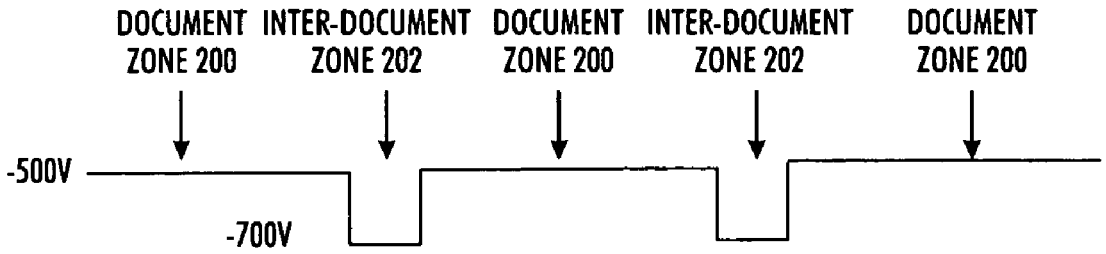
FIG. 3 is a schematic representation of charges applied to different portions of the photoreceptor.

Embodiments herein use a second charging station 100 adjacent the photoreceptor 10 between the development station C and the transfer station D. As shown in FIG. 2, the charging station 100 is adapted to charge the document zone 200 of the photoreceptor 10 with a first negative voltage and to charge the inter-document zone 202 of the photoreceptor 10 with a second negative voltage that is more negative than the first negative voltage. This is also shown graphically in FIG. 3 which illustrates that the document zone 200 portions of the photoreceptor 10 are uniformly charged to −500V, while inter-document zone 202 portions are uniformly charged to −700V. The voltage values used above are merely exemplary and one ordinarily skilled in the art would understand that the voltages could be of any value and of any polarity, depending upon the type of printer engine being utilized and its operating characteristics. For example, any voltage values from 1V to −1000V (or more positive) or −1V to 1000V (or more negative) could be used, so long as the voltage values of the inter-document zone 202 is larger (more positive or more negative) than the voltage values of the document zone 200 by at least a certain percentage sufficient to neutralize some positive charge current from the transfer charge.

The second more negative voltage reduces an amount of positive charges trapped within layers of the inter-document zone 202 of the photoreceptor 10. Thus, when the charging station 22 increases the size of the document zone 200 from a smaller size associated with a smaller printing medium to a larger size associated with a larger printing medium, by reducing the positive charges from being trapped within layers of the inter-document zone 202 of the photoreceptor 10, ghosting is reduced on the larger printing medium. The ghosting is reduced mostly on the portion of the larger printing medium that is longer than the smaller printing medium. Thus, by reducing the positive charges from being trapped within layers of the inter-document zone 202 of the photoreceptor 10, ghosting is reduced on the leading and/or trailing edges of the printing medium.

Figure 4:
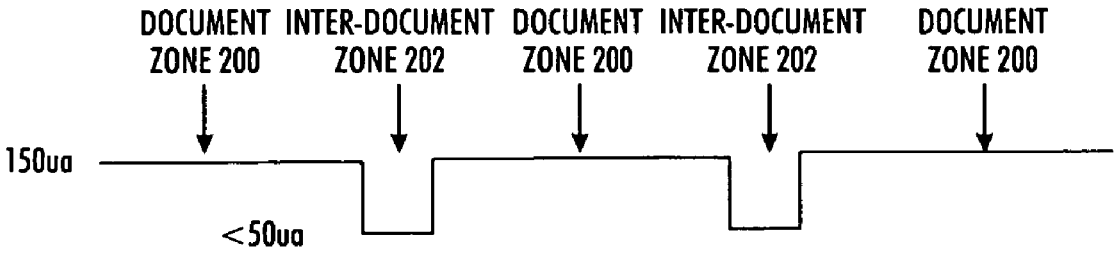
FIG. 4 is a schematic representation of transfer charges applied to different portions of the printing medium.

As shown in FIG. 4, the transfer station D applies a positive voltage current (e.g., 150 ua) to the backside of the printing medium in order to cause the toner to transfer from the photoreceptor to the printing medium. In embodiments herein, the transfer station also helps limit ghosting by shutting off, or substantially reducing the positive current (e.g., <50 ua) as the inter-document zone of the photoreceptor passes the transfer station. This is intended to aid in the effort to reduce the amount of positive charges applied to the inter-document zone of the photoreceptor. The current values used above are merely exemplary and one ordinarily skilled in the art would understand that the transfer currents could be of any value and of any polarity, depending upon the type of printer engine being utilized and its operating characteristics. For example, any current values from 1 ua to 1000 ua (or more positive) or −1 ua to −1000 ua (or more negative) could be used, so long as the second transfer current values are smaller than the first transfer current values (used for the inter-document zones 202) by at least a certain percentage. By reducing the current applied to inter-document zones 202 the ghosting effect is reduced because less positive charge is applied to the inter-document zones 202 of the photoreceptor 10.

In addition, as described in detail above, the apparatus embodiment includes a standard exposure device B adjacent the photoreceptor 10, which is used to pattern a positive charge on the document zone 200 of the photoreceptor 10. A standard development station 32 is used to attach toner to positively charged regions of the photoreceptor.

Figure 5:
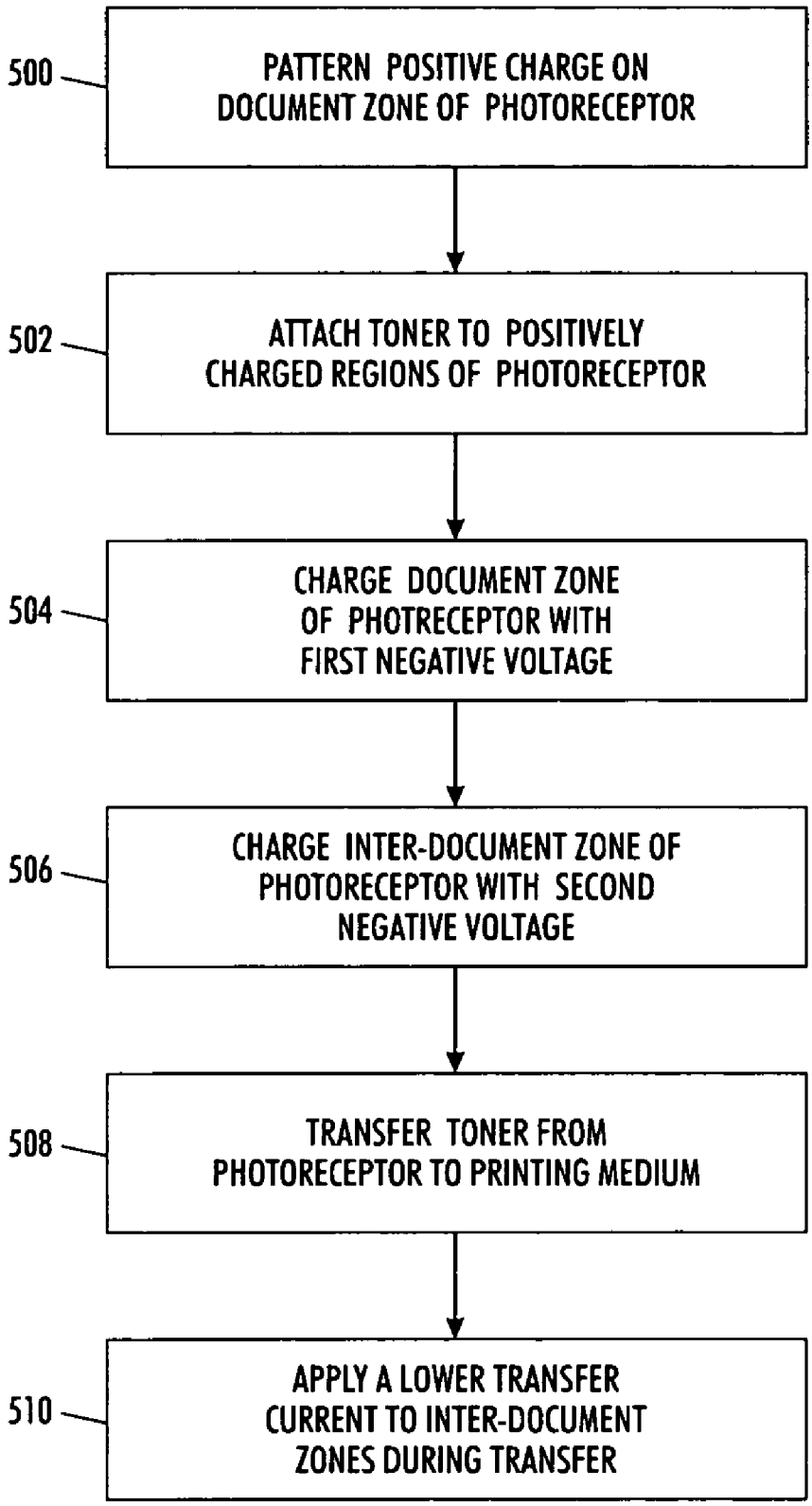
FIG. 5 is a flowchart showing a method embodiment herein.

A method embodiment (shown in flowchart form in FIG. 5) herein patterns the positive charge on the document zone of the photoreceptor 500. Next, toner is attached to the positively charged regions of the photoreceptor 502 and the toner is transferred from the photoreceptor to the printing medium. The second charging station 100 charges the document zone of the photoreceptor with the first negative voltage 504 and charges the inter-document zone of the photoreceptor with the second negative voltage 506 that is (larger) more negative than the first negative voltage. The transfer station transfers the toner from the photoreceptor to a printing medium by applying a first transfer current to the back of the printing medium 508 and applying a second transfer current (zero current or substantially reduced current) to the inter-document zone of the photoreceptor 510.

Again, with the method, the second negative voltage reduces the amount of positive charges trapped within layers of the inter-document zone of the photoreceptor. The method can increase the size of the document zone from a smaller size associated with a smaller printing medium to a larger size associated with a larger printing medium. By reducing the positive charges from being trapped within layers of the inter-document zone of the photoreceptor, ghosting is reduced on the larger printing medium. More specifically, the ghosting is reduced on the portion of the larger printing medium that is longer than the smaller printing medium. Thus, by reducing the positive charges from being trapped within layers of the inter-document zone of the photoreceptor, ghosting is reduced on the leading edges and/or trailing edges of the printing medium.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method comprising:

patterning a charge on a document zone of a photoreceptor;

attaching toner to charge patterned regions of said photoreceptor;

charging said document zone of said photoreceptor with a first voltage having a first polarity;

charging an inter-document zone of a photoreceptor with a second voltage having said first polarity and that is more biased toward said first polarity than said first voltage; and transferring said toner from said photoreceptor to a printing medium.

2. The method according to claim 1, wherein said second voltage reduces an amount of charges trapped within layers of said inter-document zone of said photoreceptor.

3. The method according to claim 1, wherein during said transferring, said printing medium contacts said document zone of said photoreceptor and does not contact said inter-document zone, and wherein said inter-document zone is between adjacent document zones of said photoreceptor.

4. A method comprising:

patterning a charge on a document zone of a photoreceptor;

attaching toner to charge patterned regions of said photoreceptor;

charging said document zone of said photoreceptor with a first voltage;

charging an inter-document zone of a photoreceptor with a second voltage that is larger than said first voltage; and transferring said toner from said photoreceptor to a printing medium, wherein said second voltage reduces an amount of charges trapped within layers of said inter-document zone of said photoreceptor; and increasing a size of said document zone from a smaller size associated with a smaller printing medium to a larger size associated with a larger printing medium, wherein by reducing said charges from being trapped within layers of said inter-document zone of said photoreceptor, ghosting is reduced on said larger printing medium.

5. A method comprising:

patterning a positive charge on a document zone of a photoreceptor attaching toner to positively charged regions of said photoreceptor;

charging a said document zone of a said photoreceptor with a first negative voltage;

charging an inter-document zone of a photoreceptor with a second negative voltage that is more negative than said first negative voltage; and transferring said toner from said photoreceptor to a printing medium by applying a first transfer current to said printing medium and applying a second transfer current lower than said first transfer current to said inter-document zone of said photoreceptor.

6. The method according to claim 5, wherein said second negative voltage reduces an amount of positive charges trapped within layers of said inter-document zone of said photoreceptor.

7. The method according to claim 6, further comprising increasing a size of said document zone from a smaller size associated with a smaller printing medium to a larger size associated with a larger printing medium, wherein by reducing said positive charges from being trapped within layers of said inter-document zone of said photoreceptor, ghosting is reduced on said larger printing medium.

8. The method according to claim 5 wherein during said transferring, said printing medium contacts said document zone of said photoreceptor and does not contact said inter-document zone, and wherein said inter-document zone is between adjacent document zones of said photoreceptor.

9. The method according to claim 5, wherein said charging of said document zone and said charging of said inter-document zone occur after said attaching of said toner to said photoreceptor.

10. An apparatus comprising:

a photoreceptor;

an exposure device adjacent said photoreceptor, wherein said exposure device is adapted to pattern a charge on said document zone of said photoreceptor;

a development station adjacent said photoreceptor, wherein said development station is adapted to attach toner to charge patterned regions of said photoreceptor; and a charging station adjacent said photoreceptor, wherein said charging station is adapted to charge a document zone of a photoreceptor with a first voltage having a first polarity and to charge an inter-document zone of a photoreceptor with a second voltage having said first polarity that is more biased toward said first polarity than said first voltage; and a transfer station adjacent said photoreceptor, wherein said transfer station is adapted to transfer said toner from said photoreceptor to a printing medium.

11. The apparatus according to claim 10, wherein said second voltage reduces an amount of charges trapped within layers of said inter-document zone of said photoreceptor.

12. The apparatus according to claim 10, wherein said document zone comprises an area of said photoreceptor that contacts said printing medium, said inter-document zone comprises an area of said photoreceptor that does not contact said printing medium, and said inter-document zone is between adjacent document zones of said photoreceptor.

13. An apparatus comprising:

a photoreceptor;

an exposure device adjacent said photoreceptor, wherein said exposure device is adapted to pattern a charge on said document zone of said photoreceptor;

a development station adjacent said photoreceptor, wherein said development station is adapted to attach toner to charge patterned regions of said photoreceptor;

a charging station adjacent said photoreceptor, wherein said charging station is adapted to charge a document zone of a photoreceptor with a first voltage and to charge an inter-document zone of a photoreceptor with a second voltage that is larger than said first voltage; and a transfer station adjacent said photoreceptor, wherein said transfer station is adapted to transfer said toner from said photoreceptor to a printing medium, wherein said second voltage reduces an amount of charges trapped within layers of said inter-document zone of said photoreceptor, and wherein said charging station is adapted to increase a size of said document zone from a smaller size associated with a smaller printing medium to a larger size associated with a larger printing medium, wherein by reducing said charges from being trapped within layers of said inter-document zone of said photoreceptor, ghosting is reduced on said larger printing medium.

14. An apparatus comprising:

a photoreceptor;

an exposure device adjacent said photoreceptor, wherein said exposure device is adapted to pattern a positive charge on said document zone of said photoreceptor;

a development station adjacent said photoreceptor, wherein said development station is adapted to attach toner to positively charged regions of said photoreceptor;

a charging station adjacent said photoreceptor, wherein said charging station is adapted to charge a document zone of a photoreceptor with a first negative voltage and to charge an inter-document zone of a photoreceptor with a second negative voltage that is more negative than said first negative voltage; and a transfer station adjacent said photoreceptor, wherein said transfer station is adapted to transfer said toner from said photoreceptor to a printing medium by applying a first transfer current to said printing medium and applying a second transfer current lower than said first transfer current to said inter-document zone of said photoreceptor.

15. The apparatus according to claim 14, wherein said second negative voltage reduces an amount of positive charges trapped within layers of said inter-document zone of said photoreceptor.

16. The apparatus according to claim 15, wherein said charging station is adapted to increase a size of said document zone from a smaller size associated with a smaller printing medium to a larger size associated with a larger printing medium, wherein by reducing said positive charges from being trapped within layers of said inter-document zone of said photoreceptor, ghosting is reduced on said larger printing medium.

17. The apparatus according to claim 14, wherein said document zone comprises an area of said photoreceptor that contacts said printing medium, said inter-document zone comprises an area of said photoreceptor that does not contact said printing medium, and said inter-document zone is between adjacent document zones of said photoreceptor.

18. The apparatus according to claim 14, wherein said charging station is positioned with respect to said development station such that charging of said document zone and charging of said inter-document zone occur after attaching said toner to said photoreceptor.

19. A method comprising:

patterning a charge on a document zone of a photoreceptor;

attaching toner to charge patterned regions of said photoreceptor;

charging said document zone of said photoreceptor with a first voltage;

charging an inter-document zone of a photoreceptor with a second voltage that is larger than said first voltage; and transferring said toner from said photoreceptor to a printing medium, wherein said charging of said document zone and said charging of said inter-document zone occur after said attaching of said toner to said photoreceptor.

20. An apparatus comprising:

a photoreceptor;

an exposure device adjacent said photoreceptor, wherein said exposure device is adapted to pattern a charge on said document zone of said photoreceptor;

a development station adjacent said photoreceptor, wherein said development station is adapted to attach toner to charge patterned regions of said photoreceptor; and a charging station adjacent said photoreceptor, wherein said charging station is adapted to charge a document zone of a photoreceptor with a first voltage and to charge an inter-document zone of a photoreceptor with a second voltage that is larger than said first voltage; and a transfer station adjacent said photoreceptor, wherein said transfer station is adapted to transfer said toner from said photoreceptor to a printing medium, wherein said charging station is positioned with respect to said development station such that charging of said document zone and charging of said inter-document zone occur after attaching said toner to said photoreceptor.

* * * * *